US007094189B2

(12) United States Patent
Fallacaro

(10) Patent No.: US 7,094,189 B2
(45) Date of Patent: Aug. 22, 2006

(54) APPARATUS FOR FITNESS STRETCHING

(76) Inventor: Thomas Fallacaro, 6991 Caldwell Ave., Maspeth, NY (US) 11378

( * ) Notice: Subject to any disclaimer, the term of this patent is extended or adjusted under 35 U.S.C. 154(b) by 0 days.

(21) Appl. No.: 10/915,407

(22) Filed: Aug. 11, 2004

(65) Prior Publication Data

US 2005/0070408 A1 Mar. 31, 2005

Related U.S. Application Data

(60) Provisional application No. 60/493,797, filed on Aug. 11, 2003.

(51) Int. Cl.
*A63B 71/00* (2006.01)

(52) U.S. Cl. ..... 482/148; 482/78

(58) Field of Classification Search ..... 482/148, 482/907, 78, 91, 35–37; D21/695, 676, 686
See application file for complete search history.

(56) References Cited

U.S. PATENT DOCUMENTS 1,676,015 A * 7/1928 Feick ..... 280/206
2,923,545 A * 2/1960 Lytle ..... 280/206
3,013,806 A * 12/1961 Boyd ..... 280/78
3,083,037 A * 3/1963 Gordon et al. ..... 280/206
3,141,669 A * 7/1964 Chul ..... 472/17
3,156,486 A * 11/1964 Fenwick ..... 280/206
3,334,915 A * 8/1967 Sulyma et al. ..... 280/206
4,298,197 A * 11/1981 Flagg ..... 482/78
4,458,895 A * 7/1984 Turcotte ..... 482/78
4,579,336 A * 4/1986 Morin ..... 280/206
4,729,446 A * 3/1988 Sefton ..... 180/21
4,799,667 A * 1/1989 Suchy ..... 472/17
5,385,498 A * 1/1995 Parvardeh ..... 441/129
5,405,304 A * 4/1995 Petersheim et al. ..... 482/35
5,722,446 A * 3/1998 Zheng ..... 135/125
5,755,641 A * 5/1998 Pardella ..... 482/36
5,792,031 A * 8/1998 Alton ..... 482/78
5,816,983 A * 10/1998 Dawes et al. ..... 482/78
6,082,386 A * 7/2000 Zheng ..... 135/126
6,093,134 A * 7/2000 Worsham ..... 482/35
6,413,198 B1 * 7/2002 Gray ..... 482/148
6,626,801 B1 * 9/2003 Marques ..... 482/23
2002/0132709 A1 * 9/2002 Varga ..... 482/78
2002/0187880 A1 * 12/2002 Johnson ..... 482/78
2004/0224823 A1 * 11/2004 Myers et al. ..... 482/35
2005/0148436 A1 * 7/2005 Brown ..... 482/37

* cited by examiner

*Primary Examiner*—Lori Amerson
(74) *Attorney, Agent, or Firm*—Dickstein, Shapiro, Morin & Oshinsky, LLP.

(57) ABSTRACT

A fitness stretching apparatus comprising a base and a cage structure surrounding the base. The cage structure includes at least a first stretching station for performing stretching of a muscle. A second stretching station is located on the base and within the cage structure. Preferably, the second stretching station is configured for seated stretching exercises.

17 Claims, 10 Drawing Sheets

APPARATUS FOR FITNESS STRETCHING

CROSS REFERENCE TO RELATED APPLICATIONS

The present application is based on and claims priority to U.S. Provisional Patent Application Ser. No. 60/493,797, filed Aug. 11, 2003, the entire disclosure of which is incorporated herein by reference.

BACKGROUND OF THE INVENTION

1. Field of the Invention

The present invention relates to an apparatus for fitness stretching. More particularly, the present invention relates to a stand alone structure which assists a person in performing multiple stretching exercises at a central location.

2. Brief Description of the Related Art

Daily stretching is one of the most important parts of physical fitness. Weight lifting and callisthenic workouts need to be complemented with stretching before, after and sometimes during exercise. In 1988, the American College of Sports Medicine (ACSM) published specific guidelines for correct stretching techniques. The ACSM recommended stretching at least 3 days a week, and holding each stretching position for 10–30 seconds.

The aim of stretching is to gently lengthen muscles before and after any form of exercise, and to improve tissue elasticity/flexibility. If done correctly, stretching will help prevent injuries and increase athletic performance. In addition, proper stretching can provide better sports performance, good posture, greater range of motion, flexibility, fewer injuries, more graceful movements, relief from muscle soreness and better coordination. Stretching for continued flexibility is a key component to improved health. Stretching benefits all age groups, male and female alike, and can help minimize injuries that occur as an individual ages.

Most stretching exercises are performed with an individual lying on either the floor or a mat and, using the floor or mat as leverage, stretching particular muscles, for example the hamstrings and calves. Stretching exercises are also sometimes performed by leaning against a wall so as to provide some leverage.

However, as can be seen in most gyms, there are no dedicated machines which assist an individual in performing proper stretching exercises. Various apparatus have been proposed to assist in stretching, but these apparatuses only assist in stretching a limited number of muscles and are insufficient or inadequate for stretching a variety of muscles from a single location. Accordingly, there remains a need for providing a person with the ability to stretch all major muscle groups at a central location.

SUMMARY OF THE INVENTION

The present invention is a stand alone structure which assists a person with multiple stretching exercises. The apparatus includes a base preferably constructed from hard rubber. The sides of the apparatus are formed in a cage-like structure. In a preferred embodiment, the sides are constructed of tubular steel covered by foam rubber and vinyl for safety. The cage structure includes at least a first stretching station. A second stretching station is located on the base and within the cage structure.

The structure contains and entrance through which a person may enter. The top portion of the entrance preferably forms the first stretching station and includes two main crossbar sections with a plurality of handheld bars between the two main crossbar sections for performing vertical stretching exercises. The first stretching station can also be located along the top center of the structure.

In the approximate center of the apparatus is a seat for performing certain stretching exercises. The seat is preferably removable, and laterally adjustable so that it can rotate 360°. In a preferred embodiment, the seat is mounted on a track which provides several locking positions for adjustment to the height of different persons.

On one side of the seat a stretching station is provided for stretching the inner legs, back and ham strings. This stretching station includes a rail and two adjustable pads that can be moved inward and outward with respect to each other depending on the amount of stretching required by the individual. On the other side of the seat, an adjustable T-bar is provided for stretching the calf muscles. This T-bar can be adjusted to account for variable foot sizes.

On another side of the apparatus, an adjustable bar that moves up and down in a vertical plane is provided for stretching the legs, back and arms. Controls are provided on one or both sides of the apparatus for actuating the movable bar into the desired position. The adjustable bar can be moved either through electrical or pneumatic means. Alternatively, the moveable bar can be manually adjusted with, for example, a spring loaded pin and corresponding hole configuration.

With this structure, an individual is provided with a centralized structure having multiple stretching stations that allows for the stretching of many different muscle groups.

BRIEF DESCRIPTION OF THE DRAWINGS

For the purposes of illustrating the present invention, there is shown in the drawings a form which is presently preferred, it being understood, however, that the invention is not limited to the precise arrangement shown, wherein.

DETAILED DESCRIPTION OF THE INVENTION

Figure 1:
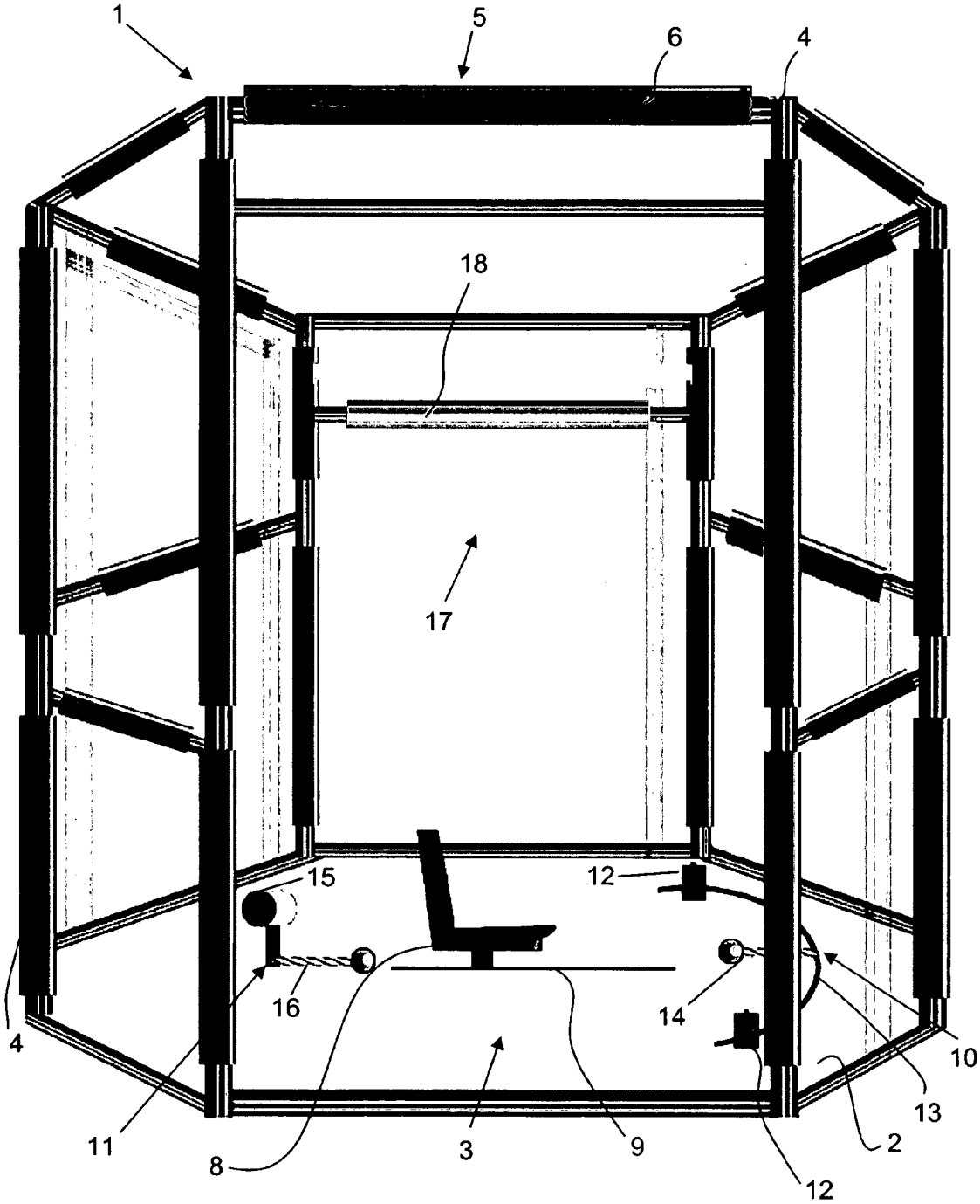
FIG. 1 is a plan view of a preferred embodiment of the stretching apparatus of the present invention.

Referring now to the drawings, FIG. 1 shows a preferred configuration of the fitness stretching apparatus 1 of the present invention. As shown in FIG. 1, the fitness stretching apparatus includes a base 2 and a cage structure 4 surrounding the base 2. Preferably, the base 2 is formed from a hard rubber material such as that commonly used to cover the floor of an exercise gym. In the preferred embodiment, the cage structure 4 includes eight sides (See FIG. 2). Although the preferred embodiment is shown as having eight sides, it will be readily apparent that other configurations having a different number of sides can be formed. The cage structure 4 is perfectly formed from a plurality of tubular steel members covered by padding for protecting the individual.

Figure 2:
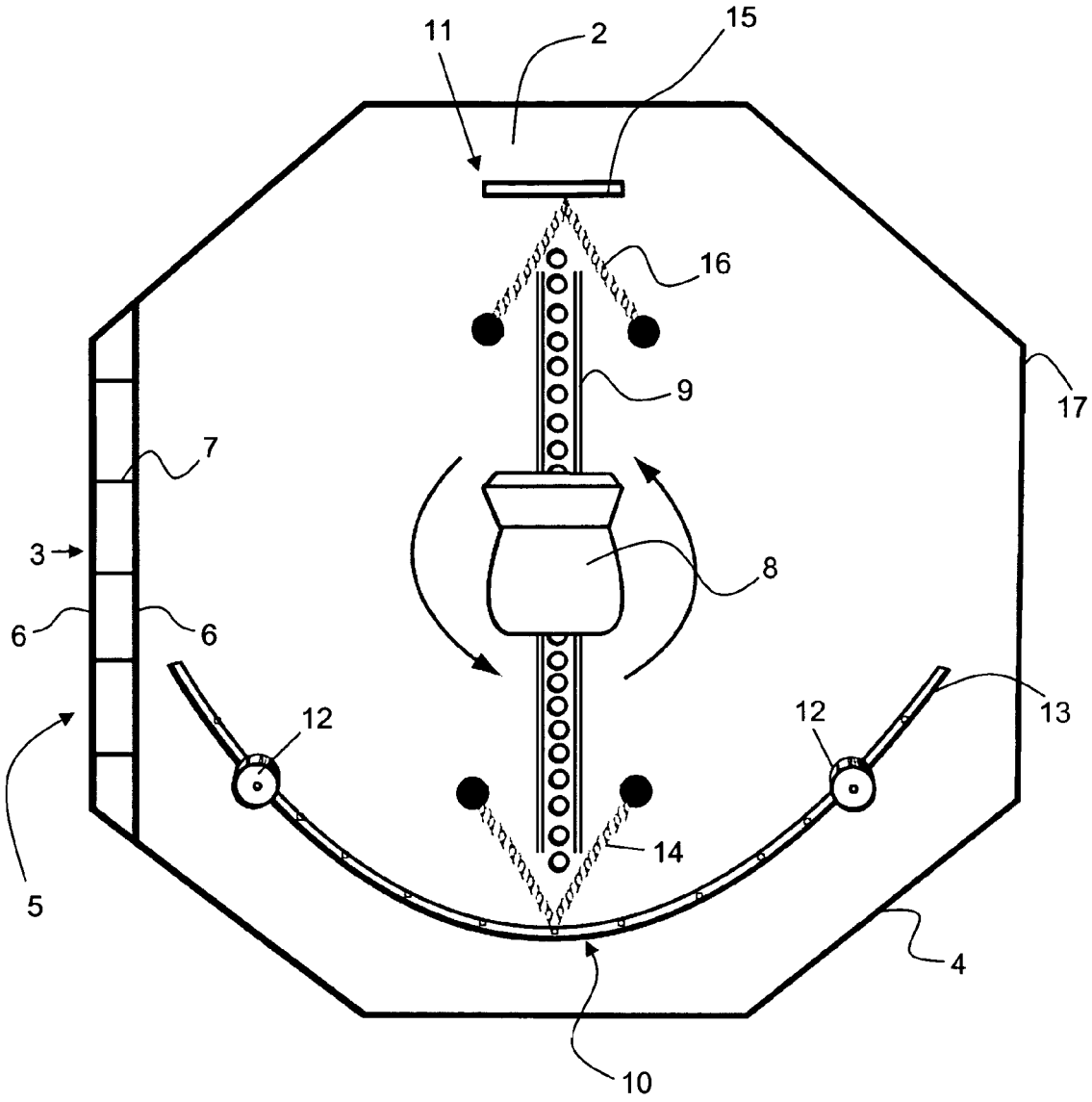
FIG. 2 is a top view of the apparatus of FIG. 1.

Of the eight sides of the cage structure 4, one of the sides includes an entrance 3 through which a person may enter the structure 4. As shown in FIGS. 1 and 2, the top portion of the entrance 3 preferably includes a first stretching station 5 configured as a horizontal grab bar for performing vertical stretching exercises. The first stretching station 5 includes two main crossbar members 6 with a plurality of hand-held bars 7 therebetween. Although FIGS. 1 and 2 show the first stretching station 5 located directly above the entrance 3 of the cage structure 4, the first stretching station 5 can also be arranged along the top center of the apparatus (not shown in the drawings).

In the approximate center of the apparatus 1, a seat 8 for performing certain stretching exercises is provided. The seat 8 is preferably removable and rotatable about 360°. The seat 8 is also preferably mounted on an elongated track 9. The elongated track 9 provides several locking positions for the seat 8 to adjust for the height of different individuals performing stretching exercises from the seat 8. To facilitate easy movement of the seat 8 along the track 9, the seat 8 is preferably provided with wheels which ride along the track (not shown).

Figure 3A:
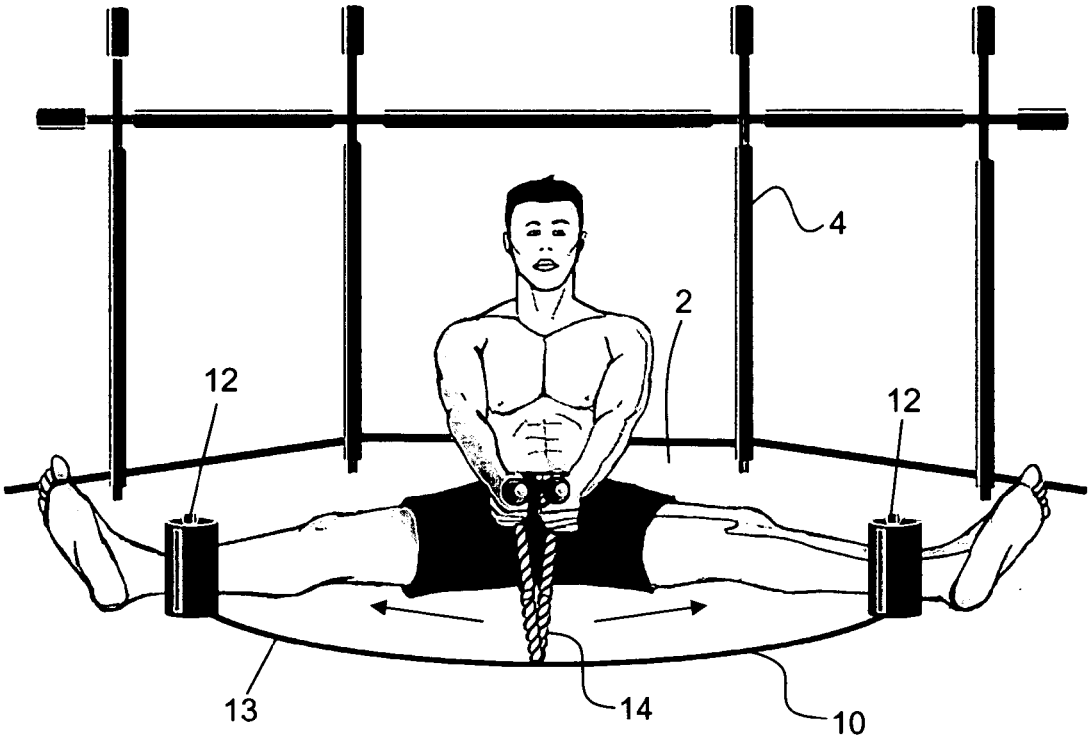
FIGS. 3A, 3B and 3C show the stretching apparatus being used to perform lower back and inner thigh stretching exercises.
Figure 3B:
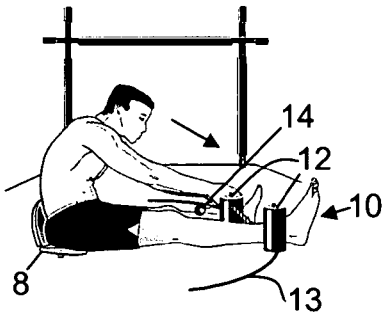
Figure 3C:
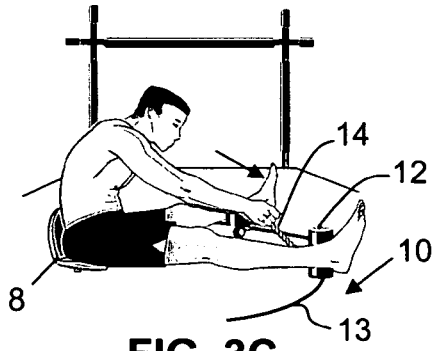

As shown in FIGS. 1 and 2, second and third stretching stations 10, 11 are provided at opposite ends of the elongated track 9. The second stretching station 10 is a work station preferably provided for stretching the inner legs, back and hamstrings, and is used in conjunction with the adjustable seat 8. The second stretching station 10 preferably comprises two adjustable pads 12 that are moved into different positions along a rail 13 so as to adjust for the different needs and flexibilities of different person performing stretching exercises. As shown more clearly in FIGS. 3A, 3B and 3C, the adjustable pads 12 can be moved inwardly and outwardly along the rail 13 and used in conjunction with the seat 8 and a set of ropes 14 for providing leverage during stretching.

Figure 4:
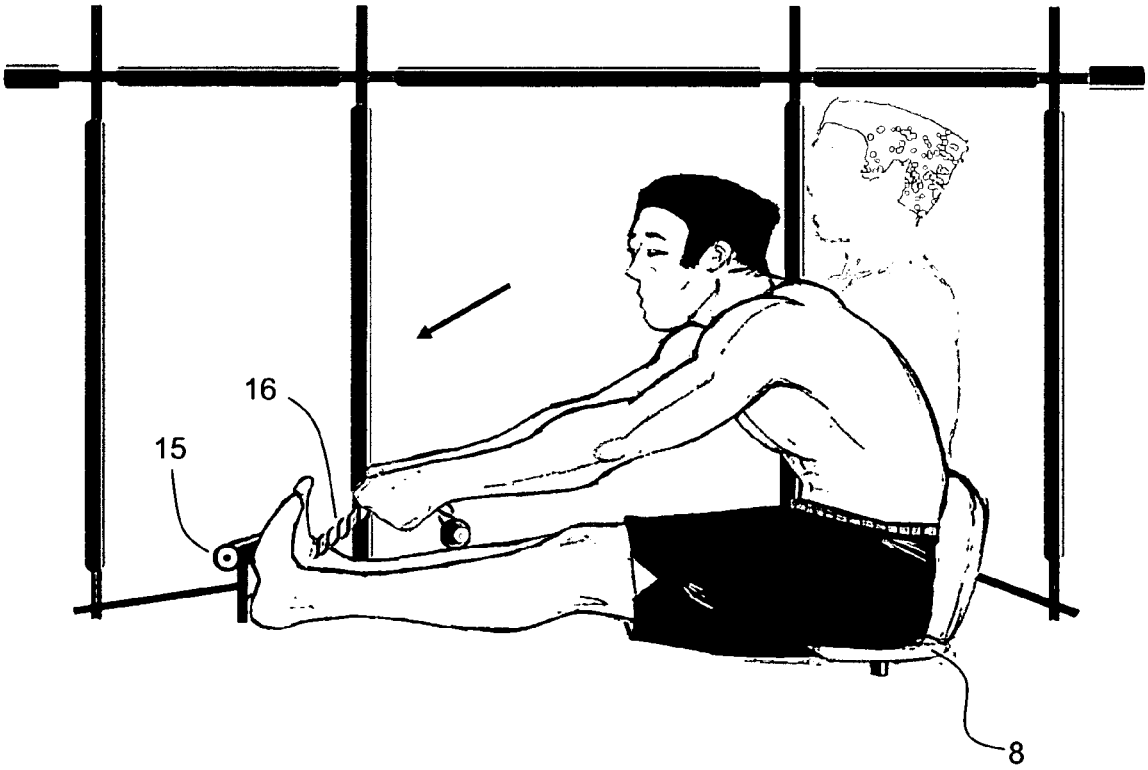
FIG. 4 shows the T-bar portion of the stretching apparatus being used to perform a calf stretching exercise.

Opposite to the second stretching station 10, a third stretching station 11 is provided. Preferably, the third stretching station 11 is configured as an adjustable T-bar 15 for stretching the calf muscles. The T-bar 15 is designed so as to be adjustable in height to account for variation in the foot sizes of the individual performing the stretching exercises. As shown in FIG. 4, the use of the seat 8 in combination with the T-bar 15 and a set of ropes 16 for leverage, enables and individual to easily stretch their calf muscles.

On a second side of the eight sides of the cage structure 4, a fourth stretching station 17 is provided for stretching the legs, back and arms. The fourth stretching station 17 is preferably configured as an adjustable bar 18 that moves up and down in a vertical plane relative to the base 2 so as to provide different heights for stretching the legs, back and arms of various individuals.

In the preferred embodiment, controls are provided on one or both sides of the apparatus for actuating the movement of the adjustable bar 18. The actuating mechanism can be either electrical or pneumatic. Alternatively, the adjustable bar 18 can be manually adjusted through the use of a spring loaded pin and corresponding hole configuration.

Figure 5:
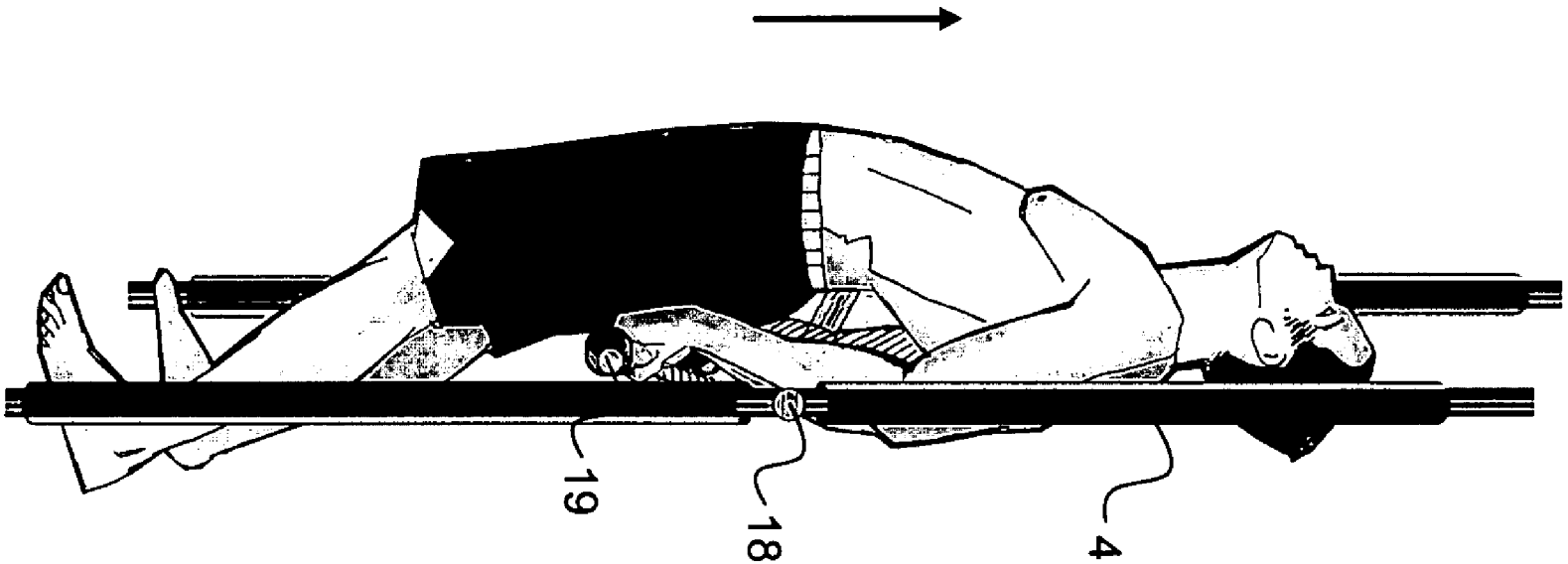
FIG. 5 shows use of the adjustable bar portion of the stretching apparatus to perform lower back, hips and abdominal stretching exercises.

FIGS. 5, 6A–6B, 7, 8, 9A–9C and 10A–10C show various exercises that can be performed with the use of the adjustable bar 18. FIG. 5 shows the use of the adjustable bar 18 in conjunction with a set of ropes 19 for stretching the abdominals, hips and lower back. As shown in FIG. 5, the individual, while holding the ropes 19 for support, leans backwards over the bar 18 to stretch the lower back, hips and abdominal muscles.

Figure 6A:
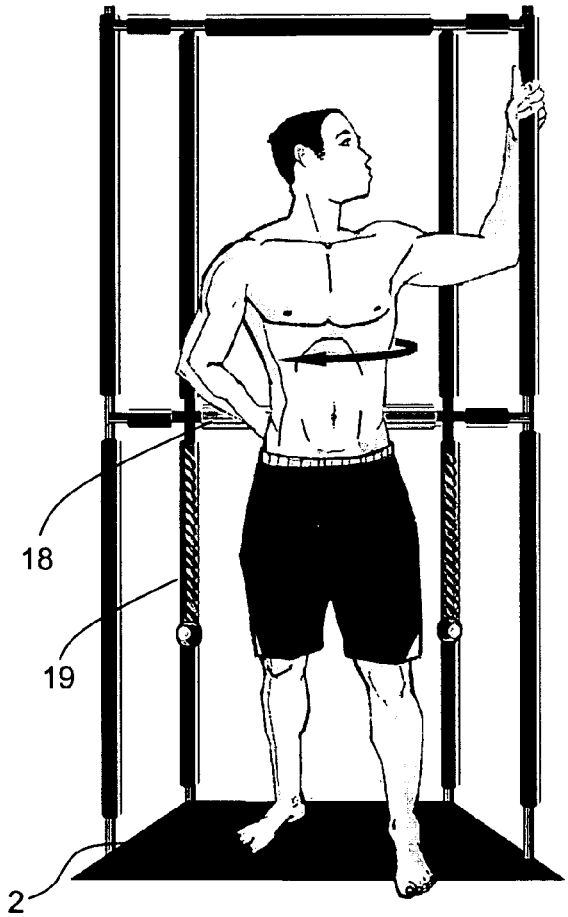
FIGS. 6A and 6B show the stretching apparatus of the present invention being used to perform chest stretching exercises.
Figure 6B:
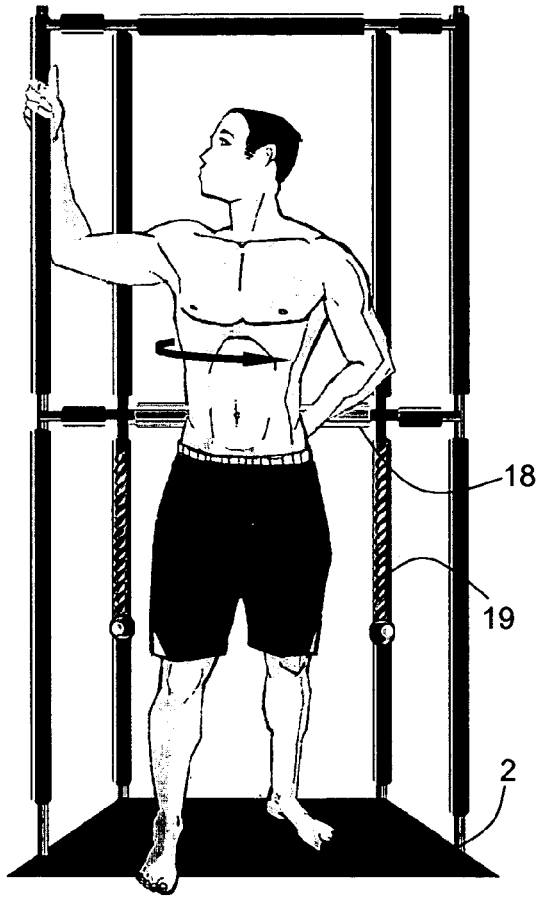

FIGS. 6A and 6B show the use of the adjustable bar 18 to stretch the chest muscles. With this stretch, an individual places one of their arms on the adjustable bar 18 such that the arm contacts the adjustable bar 18 along the forearm portion. While moving the chest outward, the arm is held in position on the bar, and a proper chest stretch is performed. As shown in FIGS. 6A and 6, this stretch can be conducted for each side of the chest.

Figure 7:
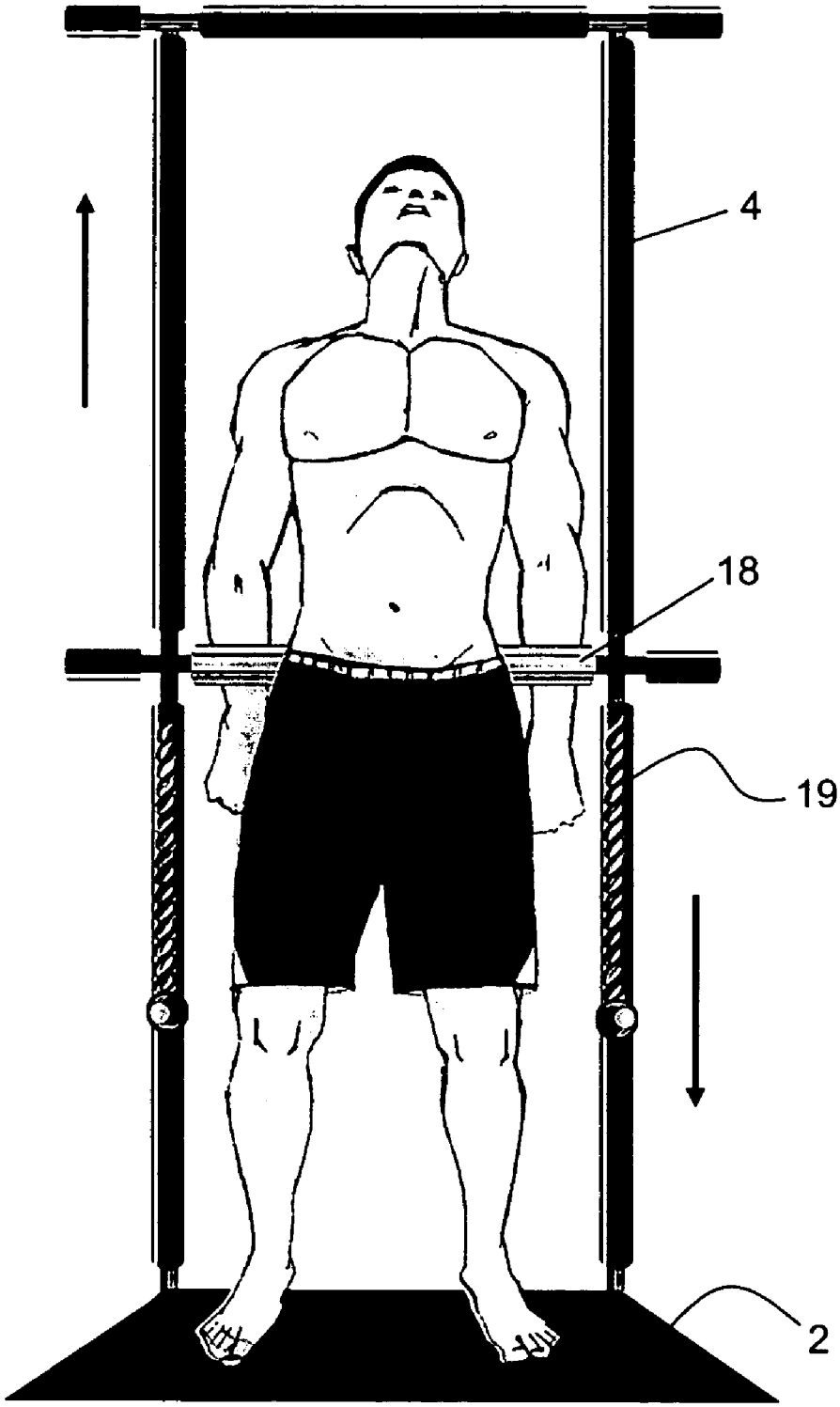
FIG. 7 shows the stretching apparatus of the present invention being used to perform a deltoid stretching exercise.

FIG. 7 shows the use of the adjustable bar 18 to stretch the deltoid muscles. With this type of stretch, the individual first raises or lowers the adjustable bar 18 to a desired height. Then, the individual places each of their arms behind the adjustable bar 18 so that they are contacting the adjustable bar 18 between the wrist and elbow. The individual then takes one step forward while keeping their arms behind the bar to obtain a good stretch of the deltoids.

Figure 8:
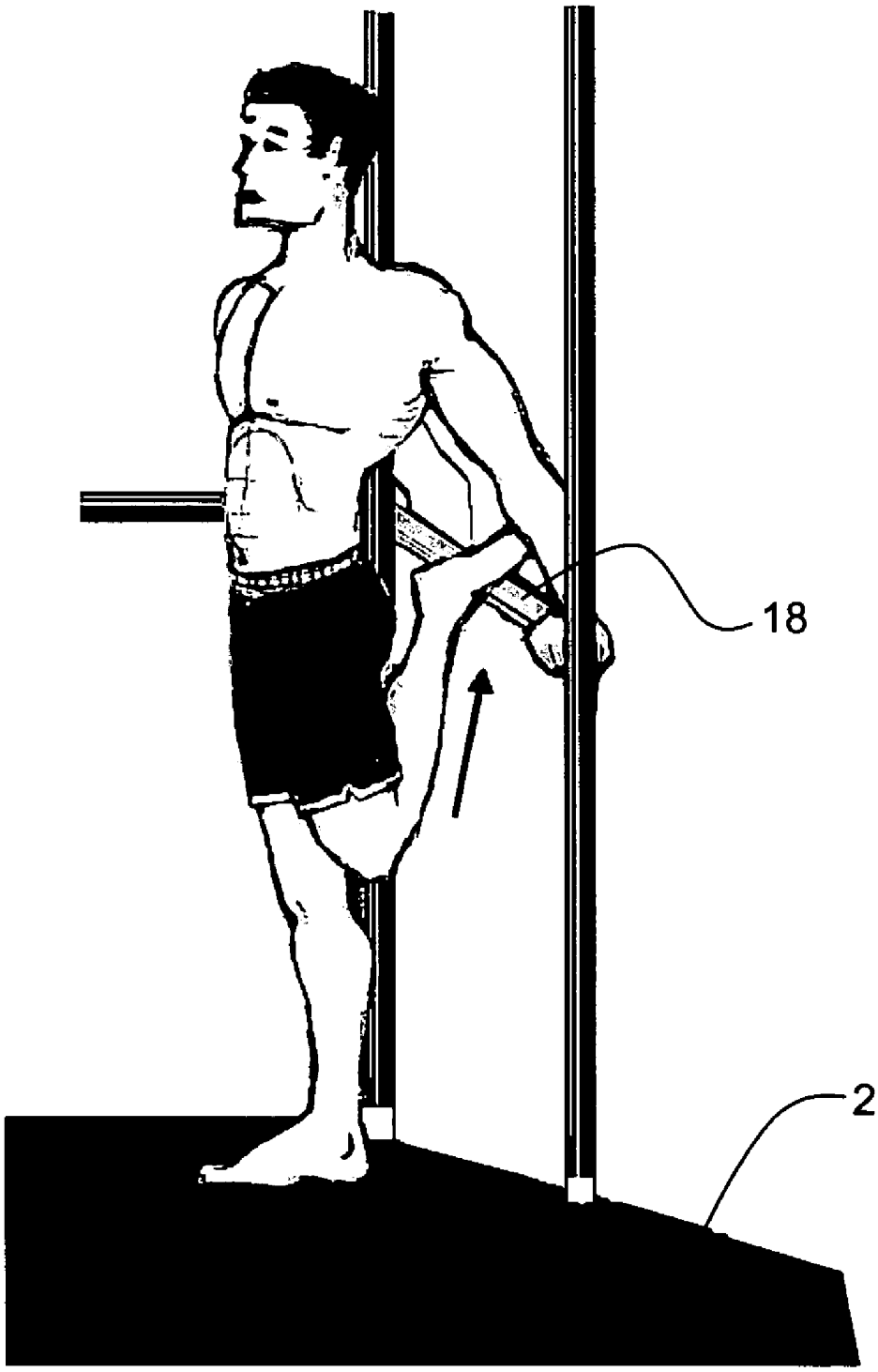
FIG. 8 shows the stretching apparatus of the present invention being used to perform a quadriceps stretch.

As shown in FIG. 8, the adjustable bar 18 can be used to easily perform a quadriceps stretch. First, the adjustable bar 18 is moved to a comfortable height. Next, the individual places one foot behind their body and on top of the adjustable bar 18. To perform the stretch of the quadriceps, the individual pushes the heal of their foot towards their buttocks while pointing the knee of that leg towards the base 2. This position is then held for a desired amount of time to obtain a stretch. This process can be repeated for each leg.

Figure 9A:
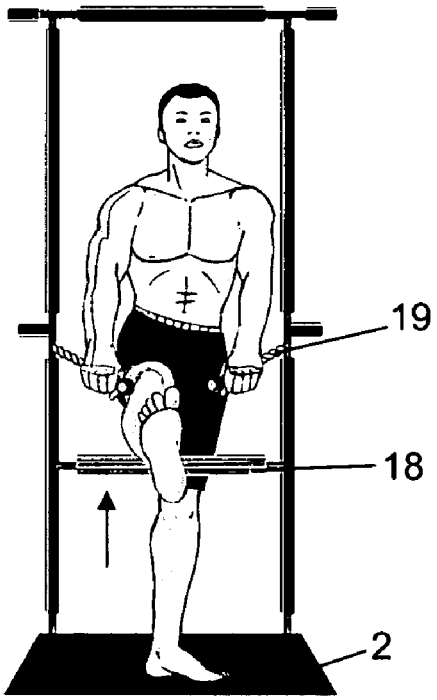
FIGS. 9A, 9B and 9C show the stretching apparatus of the present invention being used to stretch the legs and hamstrings.
Figure 9B:
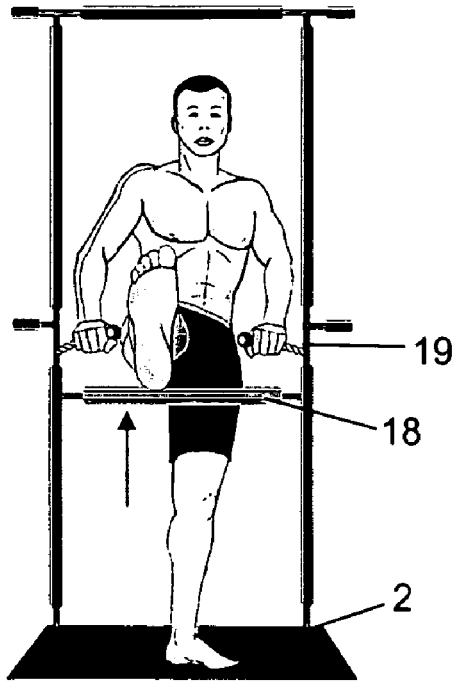
Figure 9C:
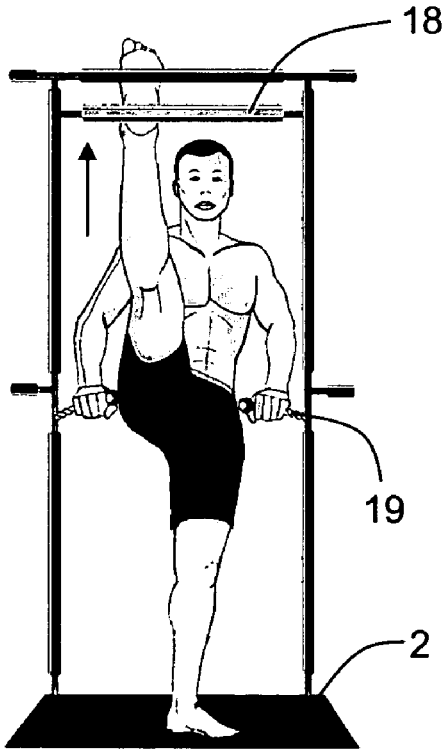

FIGS. 9A–9C show the use of the adjustable bar 18 to perform a leg and hamstring muscle stretch. This stretch is started as shown in FIG. 9A by the individual placing their leg on the adjustable bar 18. Then, as shown in FIG. 9B, the individual slowly raises the adjustable bar 18 to begin the stretch while preferably holding on to the ropes 19 for support. Continuing on, the individual then raises the adjustable bar 18 slowly to their comfortable maximum height to completely stretch the leg and hamstring muscles as shown in FIG. 9C. This process can also be repeated for each leg.

Figure 10A:
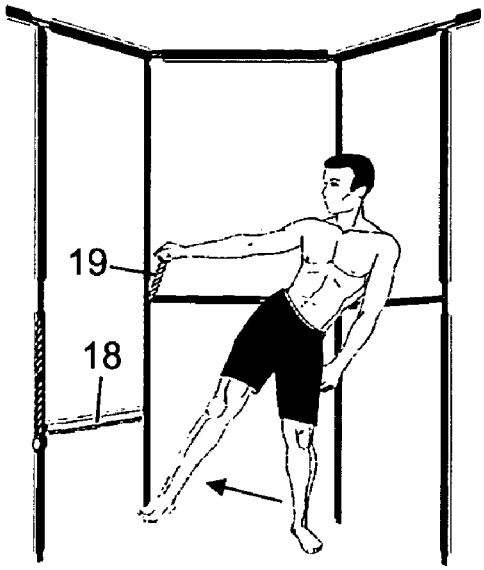
FIGS. 10A, 10B and 10C show the stretching apparatus of the present invention being used to stretch the hamstrings and groin muscles.
Figure 10B:
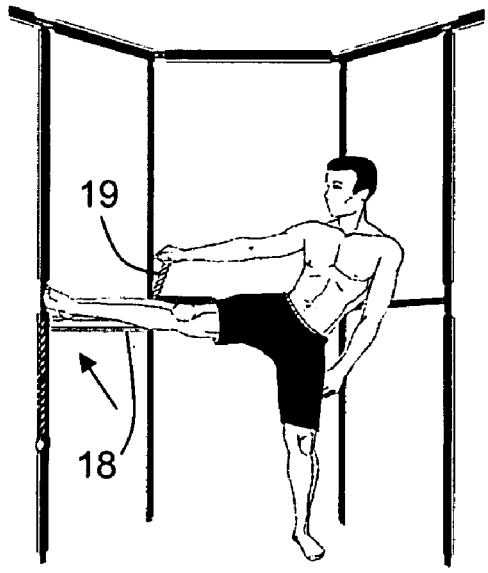
Figure 10C:
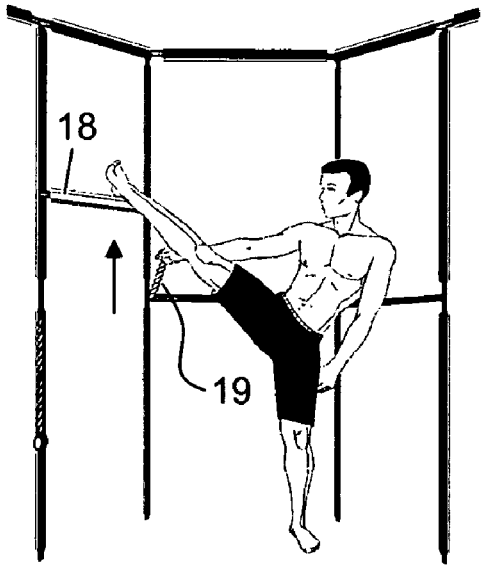

As shown in FIGS. 10A–10C, a leg and groin muscle stretch can be performed with the individual positioned sideways next to the adjustable bar 18. Similar to the leg and hamstring stretch shown in FIGS. 9A–9C, this stretch is started by the individual placing their leg sideways on the adjustable bar 18 as shown in FIG. 10A. Then, as shown in FIG. 10B, the individual slowly raises the adjustable bar 18 to begin the stretch while preferably holding on to the ropes 19 for support. Continuing, the individual then raises the adjustable bar 18 slowly to their comfortable maximum height to completely stretch the leg and groin muscles as shown in FIG. 10C. This process can also be repeated for each leg.

So as to not take up more space than is needed, in the preferred embodiment, the total length of the stretch apparatus is approximately seven and one-half feet, and the width is approximately eight feet. Also, the height of the apparatus is preferably approximately seven feet.

Although the present invention has been described in relation to particular embodiments thereof, many other variation and modifications and other uses will become apparent to those skilled in the art. It is preferred, therefore, that the present invention be limited not by the specific disclosure herein, but only by the pending claims.

What is claimed is:

1. A fitness stretching apparatus comprising:

a base;

a cage structure surrounding the base, the cage structure including a first stretching station;

a second stretching station located on the base and within the cage structure; and a third stretching station included on the cage structure, wherein the second stretching station includes a seat and a rail arrangement having adjustable pads for stretching the inner legs.

2. The fitness stretching apparatus according to claim 1, wherein the base is a mat.

3. The fitness stretching apparatus according to claim 1, wherein the cage structure includes an entrance for egress to and egress from the cage structure.

4. The fitness stretching apparatus according to claim 3, wherein the entrance forms at least part of the first stretching station.

5. The fitness stretching apparatus according to claim 4, wherein the first stretching station is a horizontal grab bar which includes two main crossbar members with a plurality of hand-held bars therebetween.

6. The fitness stretching apparatus according to claim 1, wherein the first stretching station is a horizontal grab bar which includes two main crossbar members with a plurality of hand-held bars therebetween.

7. The fitness stretching apparatus according to claim 1, wherein the first stretching station is an adjustable bar that is capable of movement in a vertical plane relative to the base.

8. The fitness stretching apparatus according to claim 1, wherein the seat is adjustable.

9. The fitness stretching apparatus according to claim 1, wherein the second stretching station further includes a T-bar structure for stretching the calves.

10. The fitness stretching apparatus according to claim 9, wherein the T-bar structure is adjustable.

11. The fitness stretching apparatus according to claim 9, wherein the seat is adjustable.

12. The fitness stretching apparatus according to claim 1, wherein the first stretching station is a horizontal grab bar which includes two main crossbar members with a plurality of hand-held bars therebetween; and the third stretching station is an adjustable bar that is capable of movement in a vertical plane relative to the base.

13. The fitness stretching apparatus according to claim 12, wherein the second stretching station further includes a T-bar structure for stretching the calves.

14. A fitness stretching apparatus comprising:

a base;

a cage structure surrounding the base, the cage structure including a first stretching station;

a second stretching station located on the base and within the cage structure; and a third stretching station included on the cage structure, wherein the second stretching station includes:

a rail arrangement having adjustable pads for stretching the inner legs;

a T-bar structure for stretching the calves; and a seat located between the rail arrangement and the T-bar structure, the seat being adjustable so as to cooperate with either the rail arrangement or the T-bar structure.

15. A fitness stretching apparatus comprising:

a cage structure which includes a plurality of vertical and horizontal members, the cage structure defining a first stretching station, a second stretching station, and a third stretching station positioned within the cage structure and including a seat, the third stretching station further including:

a rail arrangement having adjustable pads for stretching the inner legs; and a T-bar structure for stretching the calves, the seat being located between the rail arrangement and T-bar structure and adjustable so as to cooperate with either the rail arrangement or the T-bar structure.

16. The fitness stretching apparatus according to claim 15, wherein the first stretching station is configured as a horizontal grab bar which includes two main crossbar members with a plurality of hand-held bars therebetween for performing a vertical stretch.

17. The fitness stretching apparatus according to claim 16, wherein the second stretching station is configured as an adjustable bar that is located between at least two of the plurality of vertical and horizontal members and capable of movement in a vertical plane.

* * * * *